United States Patent [19]

Ripa

[11] 4,207,740

[45] Jun. 17, 1980

[54] VALVE BLOCKS, IN PARTICULAR FOR HYDRAULIC EXCAVATORS

[75] Inventor: Björn S. Ripa, Helsingborg, Sweden

[73] Assignee: Akermans Verkstad AB, Eslov, Sweden

[21] Appl. No.: 47,771

[22] Filed: Jun. 12, 1979

[51] Int. Cl.[2] ..... F15B 13/06; F15B 13/09

[52] U.S. Cl. ..... 60/486; 91/530; 137/596.13; 414/694

[58] Field of Search ..... 60/421, 486; 91/508, 91/519, 525, 530; 414/694, 699; 137/596.13

[56] References Cited

U.S. PATENT DOCUMENTS

| | | | |
|---|---|---|---|
| 3,800,669 | 4/1974 | Distler | 91/519 |
| 4,024,710 | 5/1977 | Zelle | 60/486 X |

*Primary Examiner*—Edgar W. Geoghegan
*Attorney, Agent, or Firm*—Blair, Brown & Kreten

[57] ABSTRACT

A valve block for hydraulic excavators having at least two sets of valves which are each coupled to their pump. The valves are of the type which, in the unactuated state, allows the passage of pressure medium. The hydraulic devices for executing working movements of the excavator are each coupled to their valve in each set. The valves in the one set are coupled in series, counted from the pump in the sequence the valve which is coupled to the hydraulic device for the first working movement of the excavator, the valve which is coupled to the hydraulic device for the second working movement of the excavator, and the valve which is coupled to the hydraulic device for the third working movement of the excavator. The valves in the second set are similarly coupled in series counted from the pump in the sequence the valve which is coupled to the hydraulic device for the third working movement of the excavator, the valve which is coupled to the hydraulic device for the second working movement of the excavator and the valve which is coupled to the hydraulic device for the first working movement of the excavator. In the case when the excavator has caterpillar tracks driven by means of hydraulic motors, one valve for each of the hydraulic motors may be coupled before, after or in parallel with each series of valves to the hydraulic devices for executing the working movements of the excavator.

5 Claims, 2 Drawing Figures

VALVE BLOCKS, IN PARTICULAR FOR HYDRAULIC EXCAVATORS

Figure 1:
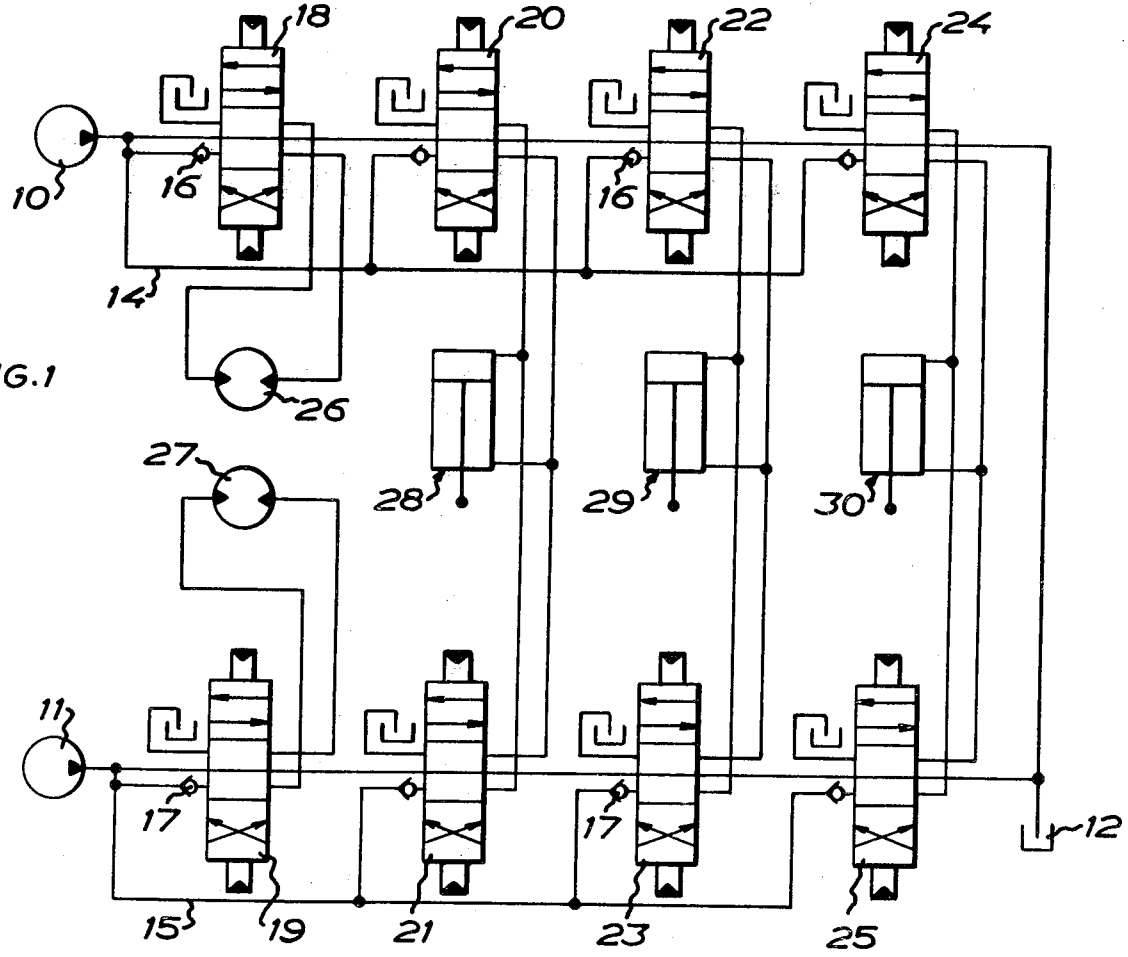

The present invention relates to a valve block, in particular for hydraulic excavators, having at least two valve sets which are each coupled to a pump, the hydraulic devices for executing the working movements of the excavator, for example swinging the boom, stick and bucket, being each connected to a valve in each set, the valves being of the type which, in the unactuated state, allows the passage of pressure medium through to a following valve.

For regulating the movements of the hydraulic devices which execute the various working movements in a hydraulic excavator, a plurality of valve arrangements are known. Often, but not always, use is made of two pumps for effecting these movements, whereby it is possible to connect, by the intermediary of primary and secondary valves, one hydraulic device to one or both of the pumps, whereby the hydraulic device may be caused to work at low or high speed, respectively. In such a case, the valves are coupled in parallel in two valve sets which are each connected to a pump. It may seem as if such an arrangement might be fully adequate and advantageous, since the valves may, independently of each other, supply pressure medium to the hydraulic devices such that the working movements of the excavator may be combined in any given manner and may be effected at suitable speed. However, such is not the case in reality. For example, in excavation work, it is often necessary to execute a planar horizontal bucket movement, for example, for realizing a flat substrate in pipe laying work in a ditch or the like. This entails that the hydraulic devices of the stick and boom must be driven simultaneously with great precision. In hydraulic systems of the above type, problems then occur in leading the pressure medium out to both hydraulic devices at the same time, since the pressure needs in these hydraulic devices differ considerably from each other. The reason for this is that, in valves which are coupled in parallel, the pressure medium strives to flow to that hydraulic device having the lowest pressure. It is then necessary, by a series of jerk movements, to throttle the pressure in those valves whose hydraulic device has the lowest pressure in order to produce movement in the hydraulic device which requires the highest pressure. This is a difficult operation and often results in an alternating movement in first the one hydraulic device and then the other.

The object of the present invention is, by means of a valve block whose valves are coupled in a novel manner, to obviate the above-mentioned problems and simultaneously to retain essentially all of the advantages inherent in prior art arrangements.

According to the invention, the valves included in the one set are coupled in series, that valve which is coupled to the hydraulic device for executing the first working movement being closest to the pump, followed by that valve which is coupled to the hydraulic device for executing the second working movement, and, finally, that valve which is coupled to the hydraulic device for executing the third working movement being disposed most distal from the pump. Moreover, the valves included in the second set are similarly coupled in series, that valve which is coupled to the hydraulic device for executing the third working movement being located closest the pump, followed by the valve which is coupled to the hydraulic device for executing the second working movement, and, finally, the valve which is coupled to the hydraulic device for executing the first working movement being located most distal from the pump.

Thanks to a priority-coupled valve arrangement of this type, the possibility is retained of driving the hydraulic devices at low and high speed at the same time as, for example, the hydraulic devices for the stick and boom may be driven independently of each other without the pressure need in the one hydraulic device influencing the other. Because conventional valves of this type open and close gradually, it is also possible, by means of a valve arrangement coupled in this manner, to execute several working movements simultaneously. The system according to the invention makes for a much smoother regulation of the excavator movements, which facilitates, above all, leveling-off work, but the other phases in the excavation cycle also become considerably smoother in execution.

The nature of the present invention will be more readily understood from the following brief description of the accompanying drawings, and discussion relating thereto.

Figure 2:
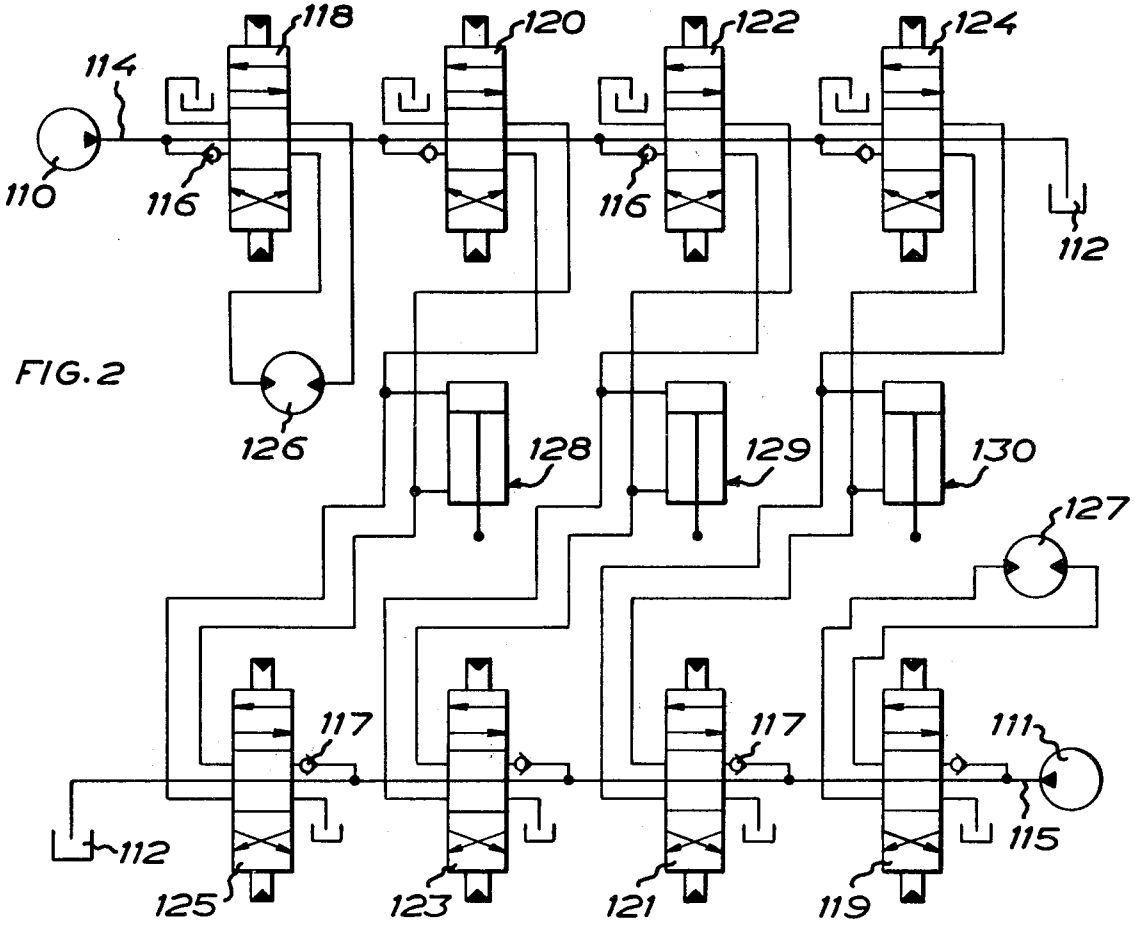

In the accompanying drawings:

FIG. 1 is a coupling diagram of a nowadays conventional valve arrangement in an excavator; and FIG. 2 is a coupling diagram of a priority-coupled valve block according to the invention.

In the valve arrangement shown in FIG. 1 (which has been used for many years), there are disposed two pumps 10 and 11 with a common pressure medium container 12. From each pump 10, 11 extends a conduit 14 and 15, respectively, and it will be apparent from FIG. 1 that a number of valves 18, 20, 22, 24, are coupled to the conduit 14 in a parallel arrangement, and that valves 19, 21, 23, 25 are coupled to the conduit 15 similarly in a parallel arrangement. The valves 18 and 19, respectively, located most proximal the pumps 10 and 11 are each connected to a hydraulic motor 26 and 27, respectively, for driving the caterpillar tracks of the excavator. The valves 20 and 21 are connected to a hydraulic device 28 which produces the stick movements of the excavator. The valves 22 and 23 are connected to a hydraulic device 29 which produces the boom movements of the excavator, and the valves 24 and 25 are connected to a hydraulic device 30 which produces the bucket movements of the excavator. Each valve has, in its supply line, a non-return valve 16 and 17, respectively. Naturally, in reality there are also further regulator and sensing devices but these have not been included in the drawings in order to avoid unnecessary complication of the presentation of this invention. It will be immediately apparent to the skilled reader of FIG. 1 that it is possible by, for example, actuating the valve 22, to connect the pump 10 to the boom hydraulic device 29 and cause this to work at a certain speed. If, moreover, the valve 23 is actuated, the pump 11 is also connected to the hydraulic device 29 whereby the working speed of this device increases. Simultaneously with this actuation of the valves 22 and 23, one or more of the remaining valves may be actuated and it is thus possible to realize any given combination of movements at a desired speed. However, in order that the system function flawlessly, it is presupposed that equal loading be placed on the different hydraulic devices, and this is seldom the case in practice, as will be apparent from the example cited by way of introduction. Uneven loading of the different hydraulic devices entails a very tiresome and troublesome adjustment of the valves in order that the hydraulic devices work in the contemplated manner.

This problem is solved by means of the valve arrangement shown in FIG. 2. In this figure, the same reference numerals have been used as in FIG. 1 but the figures are presented in hundreds instead of tens. Thus, pumps 110 and 111 are provided, as well as a pressure medium container 112, which, for purposes of clarity, is shown as being two in number. Valves 118, 120, 122, 124 are connected to the pump 110, and valves 119, 121, 123, 125 are connected to the pump 111. The valves 118 and 119 are each operative to drive their respective caterpillar track motor 126 and 127, respectively, and will, therefore, be omitted from this discussion for the time being. The pumps 110, 111 supply the valves 120, 122, 124; and 119, 121, 123, respectively, with pressure medium by means of conduits 114 and 115, respectively. The valves 118–125 are of the type which, in the unactuated state, allows the passage of pressure medium to the following valve or pressure medium container 112 and 113, respectively. In FIG. 2, the valves are not coupled in parallel but in series in a particular manner, namely such that the valves coupled to the pump 110 are arranged in the following order: the valve 120 for the stick hydraulic device 128, the valve 122 for the boom hydraulic device 129 and finally the valve 124 for the bucket hydraulic device 130. The sequence for the valves 121, 123, 125, which are coupled to the pump 111, is reversed, that is to say the valve 121 for the bucket hydraulic device 130 is located most proximal the pump 111, whereafter follow the valve 123 for the boom hydraulic device 129 and, most distal from the pump 111, the valve 125 for the stick hydraulic device 128. As in the prior art valve arrangement there are naturally, various regulator and sensing devices in the valve system and of these only the non-return valve 116 and 117 are shown, for the purposes of simplicity, since a person skilled in the art will readily appreciate what is further required.

The valves for each working movement are actuated in parallel by means of their associated hand-manipulated operating devices. When both valves are supplied with pressure medium for executing a working movement, this movement will, naturally, be executed at high speed. If low-speed movement is desired, that is to say driving by means of but one pump and none of the preceding valves in the series is actuated, there is a manually operable valve (not shown on the drawing) by means of which one or the other pump may be shunted-off to the container.

The function of the priority-coupled valve arrangement shown in FIG. 2 will now be described. To this end, the example mentioned in the introduction of this specification will be chosen, namely the execution of a planar horizontal bucket movement. If such a movement is desired, the valve 120 is actuated and is supplied with pressure medium from the pump 110 via the unactuated valve 118. The pressure medium is thereby supplied to the stick hydraulic device 128. In the same manner, the valve 123 is actuated and is supplied with pressure medium from the pump 111 via the unactuated valves 119 and 121. Pressure medium is thereby supplied to the boom hydraulic device 129 and the desired movement of the stick and boom of the excavator may be carried out. Thus, the stick and boom hydraulic devices 128 and 129 receive pressure medium each from their associated pump 110 and 111, respectively. The valves 118–125 are of the conventional type which slowly throttles or opens the pressure medium flow, this being utilized in the following manner in this operation. If the valve 123 for the boom hydraulic device 129 is slightly closed, a part of the pressure medium will be allowed through to the valve 125 which is coupled to the stick hydraulic device 128 and, in this manner, it is possible to slow down the boom movement and speed up the stick movement. The other combinations of boom/stick and stick/bucket function in the same manner.

The valves 118 and 119 for the hydraulic motors 126 and 127, respectively, for the caterpillar tracks are in both cases coupled most proximal the pumps 110 and 111 but may, naturally, also in both cases be coupled most distal from the pump, that is to say after each respective series of valves. In certain cases it is also advantageous to couple valves 118 and 119 in parallel with their associated series of valves 120, 122, 124; and 121, 123, 125, respectively.

It will be apparent to the skilled reader of the above description that it is possible by means of a simple coupling arrangement considerably to improve and simplify the regulation of excavation movements, which both increases effectivity and facilitates excavation work to a considerable extent.

What I claim and desire to secure by Letters Patent is:

1. In a valve block for machines executing working movements, in particular excavators, the combination of:

(a) at least two sets of valves, which valves are of the type which, in the unactuated state, allow the passage of pressure medium;

(b) at least a first pump which is coupled to the first set of valves;

(c) at least a second pump which is coupled to the second set of valves; and (d) hydraulic devices for executing said working movements, which hydraulic devices are each coupled to a valve in each set, the valves in the one set being coupled in series in such a manner that the valve which is coupled to the hydraulic device for executing the first working movement is located most proximal said first pump, then followed by the valve which is coupled to the hydraulic device for executing the second working movement and finally the valve which is coupled to the hydraulic device for executing the third working movement being located most distal from said first pump, and the valves in said second set being similarly coupled in series but such that the valve which is coupled to the hydraulic device for executing said third working movement is located most proximal said second pump, then followed by the valve which is coupled to the hydraulic device for executing said second working movement and finally the valve which is coupled to the hydraulic device for executing said first working movement being located most distal from said second pump.

2. The valve block as recited in claim 1, wherein of said working movements, the first working movement is the stick movement of an excavator, the second working movement is the boom movement of the excavator, and the third working movement is the bucket movement of the excavator.

3. The valve block as recited in claim 1 or 2, mounted in a machine having:

(a) caterpillar tracks;
(b) hydraulic motors for driving the caterpillar tracks; and
(c) valves which are each coupled to their caterpillar track hydraulic motor for regulating the supply of pressure medium thereto, one of said valves being coupled before the one set of series-coupled valves and the other of said valves being coupled before the second set of series-coupled valves.

4. The valve block as recited in claim 1 or 2, mounted in a machine having:
(a) caterpillar tracks;
(b) hydraulic motors for driving the caterpillar tracks; and
(c) valves which are each coupled to their caterpillar track hydraulic motor for regulating the supply of pressure medium thereto, one of said valves being coupled after the one set of series-coupled valves and the other of said valves being coupled after the second set of series-coupled valves.

5. The valve block as recited in claim 1 or 2, mounted in a machine having:
(a) caterpillar tracks;
(b) hydraulic motors for driving the caterpillar tracks; and
(c) valves which are each coupled to their caterpillar track hydraulic motor for regulating the supply of pressure medium thereto, one of said valves being coupled parallel to the one set of series-coupled valves and the other of said valves being coupled parallel to the second set of series-coupled valves.

* * * * *